US010344463B2

(12) United States Patent
Kawada et al.

(10) Patent No.: US 10,344,463 B2
(45) Date of Patent: Jul. 9, 2019

(54) SANITARY WASHING DEVICE AND TOILET APPARATUS

(71) Applicant: TOTO LTD., Kitakyushu-shi, Fukuoka (JP)

(72) Inventors: Satoshi Kawada, Fukuoka (JP); Masayuki Mochita, Fukuoka (JP); Takeshi Yamakawa, Fukuoka (JP)

(73) Assignee: TOTO LTD., Kitakyushu-shi (JP)

( * ) Notice: Subject to any disclaimer, the term of this patent is extended or adjusted under 35 U.S.C. 154(b) by 1 day.

(21) Appl. No.: 15/671,229

(22) Filed: Aug. 8, 2017

(65) Prior Publication Data

US 2018/0058057 A1 Mar. 1, 2018

(30) Foreign Application Priority Data

Aug. 25, 2016 (JP) ..... 2016-165014

(51) Int. Cl.

| | |
|---|---|
| ***E03D 9/08*** | (2006.01) |
| ***A47K 13/30*** | (2006.01) |
| ***E03D 11/13*** | (2006.01) |
| *A47K 13/24* | (2006.01) |

(52) U.S. Cl.

CPC ..... *E03D 9/085* (2013.01); *A47K 13/30* (2013.01); *A47K 13/302* (2013.01); *E03D 9/08* (2013.01); *E03D 11/13* (2013.01); *A47K 13/24* (2013.01)

(58) Field of Classification Search

CPC ..... E03D 9/08; A47K 13/30

USPC ..... 4/420.4

See application file for complete search history.

(56) References Cited

U.S. PATENT DOCUMENTS

| | | | | |
|---|---|---|---|---|
| 2003/0126677 | A1 | 7/2003 | Idota et al. | |
| 2005/0246828 | A1* | 11/2005 | Shirai | E03D 9/08 4/420.4 |
| 2015/0020302 | A1* | 1/2015 | Zwicker | B05B 7/0425 4/443 |
| 2016/0258151 | A1* | 9/2016 | Shiraishi | E03D 9/08 |

FOREIGN PATENT DOCUMENTS

| | | |
|---|---|---|
| DE | 202013001133 | 3/2014 |
| DE | 202015001722 | 6/2016 |
| EP | 1959061 | 8/2008 |
| KR | 20-0320671 | 7/2003 |

OTHER PUBLICATIONS

Extended European Search Report for European Patent Application No. 17187754.1 dated Jan. 5, 2018.

* cited by examiner

*Primary Examiner* — Huyen D Le

(74) *Attorney, Agent, or Firm* — Amin, Turocy & Watson LLP

(57) ABSTRACT

A sanitary washing device according to an embodiment includes a casing, a water supply pipe, and a recess. The water supply pipe is connected to the casing. The recess is arranged on one of left and right peripheral sides of the casing and forms, on a lower surface of the casing, an open space capable of laying the water supply pipe.

8 Claims, 10 Drawing Sheets

SANITARY WASHING DEVICE AND TOILET APPARATUS

CROSS-REFERENCE TO RELATED APPLICATION

The present application claims priority to and incorporates by reference the entire contents of Japanese Patent Application No. 2016-165014 filed in Japan on Aug. 25, 2016.

FIELD

A disclosed embodiment relates to a sanitary washing device and a toilet apparatus.

BACKGROUND

A sanitary washing device has conventionally been known that is installed on an upper surface of a toilet, and executes washing of, for example, a private part of a person that sits on a toilet seat. In such a sanitary washing device, a water supply pipe may be installed so as not to be exposed to an outside thereof, for example, so as to hide the water supply pipe in an internal space of a toilet (see, for example, Japanese Laid-open Patent Publication No. 2014-189999). Accordingly, a through-hole where a water supply pipe is inserted therethrough is provided on an upper surface of a toilet in order to introduce the water supply pipe into an internal space of the toilet (see, for example, Japanese Laid-open Patent Publication No. 2014-147445).

However, in a conventional sanitary washing device as described above, for example, a through-hole of a toilet may be provided at a variety of positions depending on a specification thereof, so that a water supply pipe that does not correspond to a position of a through-hole may be exposed to an outside thereof to degrade a design or appearance thereof or complicate construction thereof. That is, there is room for improvement in a conventional sanitary washing device in that a design or construction thereof is improved.

SUMMARY

It is an object of the present invention to at least partially solve the problems in the conventional technology.

According to an aspect of an embodiment, a sanitary washing device includes a casing, a water supply pipe that is connected to the casing, and a recess that is arranged on one of left and right peripheral sides of the casing and forms, on a lower surface of the casing, an open space capable of laying the water supply pipe.

BRIEF DESCRIPTION OF DRAWINGS

The above and other objects, features, advantages and technical and industrial significance of this invention will be better understood by reading the following detailed description of presently preferred embodiments of the invention, when considered in connection with the accompanying drawings, wherein.

DESCRIPTION OF EMBODIMENT

Hereinafter, an embodiment of a sanitary washing device and a toilet apparatus as disclosed in the present application will be described in detail, with reference to the accompanying drawings. Herein, this invention is not limited by an embodiment as illustrated below.

Toilet Apparatus

Figure 1:
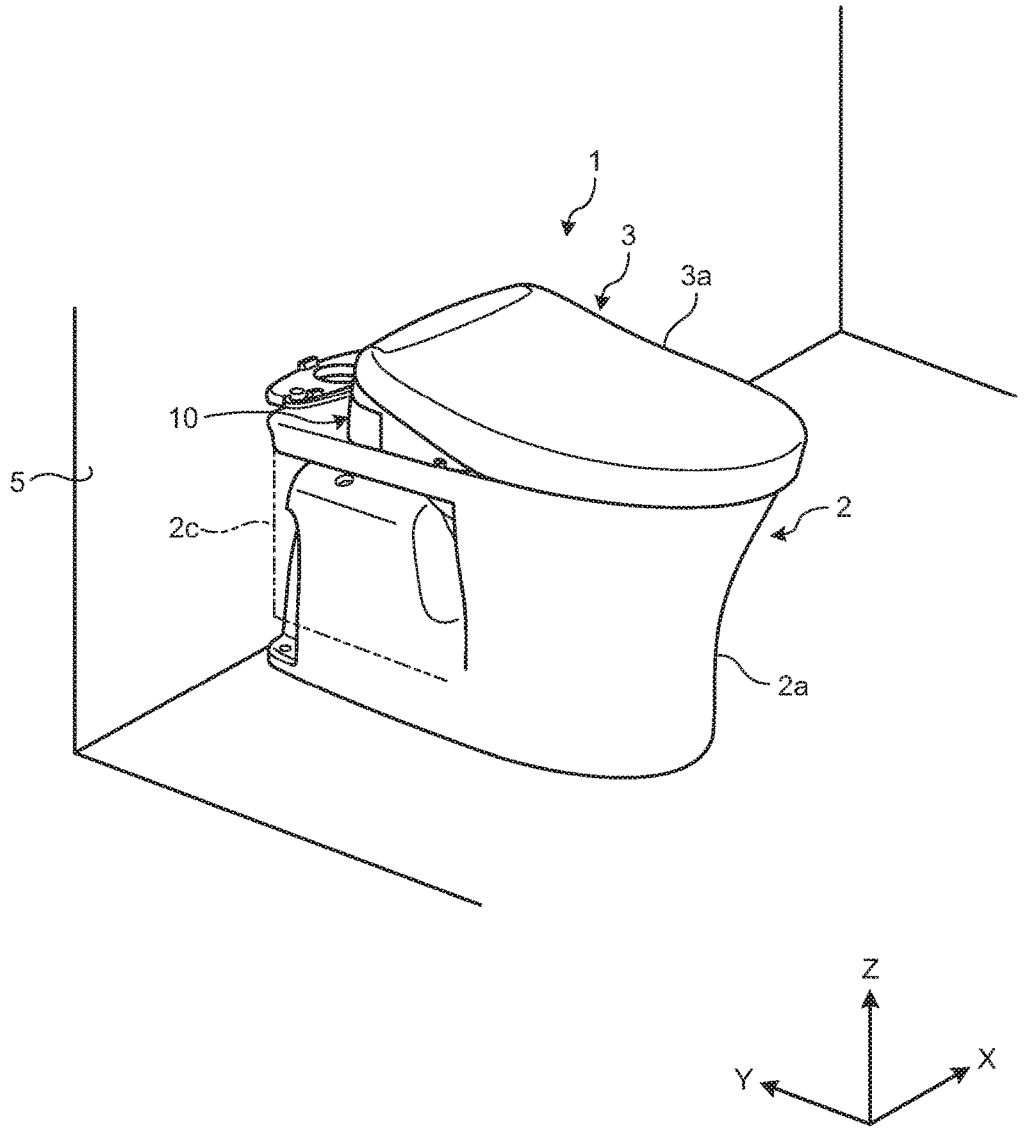
FIG. 1 is a schematic perspective view (part 1) of a toilet apparatus according to an embodiment.
Figure 2:
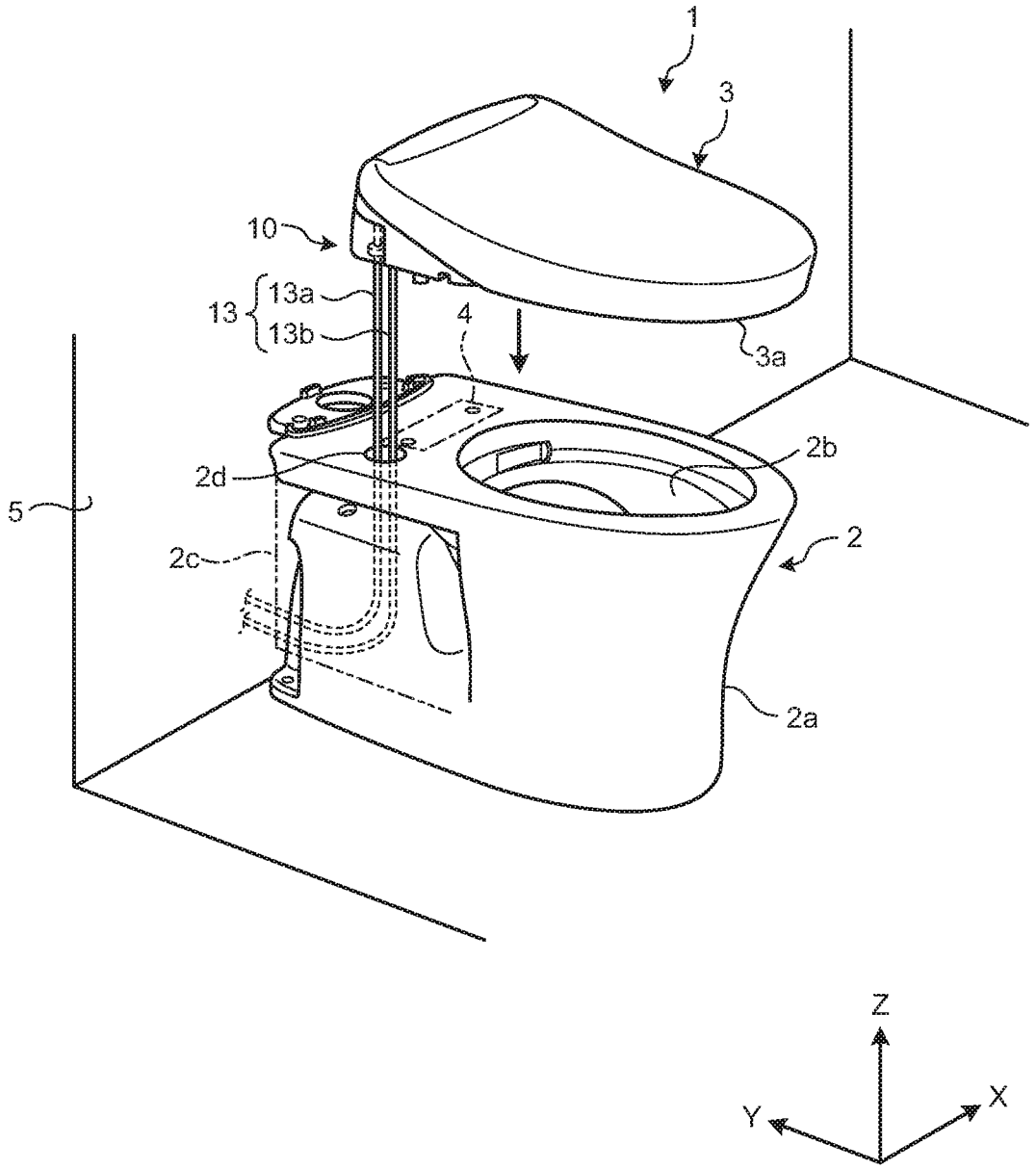
FIG. 2 is a schematic perspective view (part 2) of a toilet apparatus according to an embodiment.

First, a general configuration of a toilet apparatus 1 according to an embodiment will be described with reference to FIG. 1 and FIG. 2. FIG. 1 and FIG. 2 are schematic perspective views of a toilet apparatus 1 according to an embodiment. Among these, FIG. 2 illustrates a mounting state of a sanitary washing device 10.

Herein, FIG. 1 and FIG. 2 illustrate a three-dimensional orthogonal coordinate system that includes a Z-axis with a positive direction being a vertically upward direction in order to cause the description to be readily understood. Such an orthogonal coordinate system may be illustrated in another drawing.

Furthermore, such an orthogonal coordinate system defines a view in a positive direction of a Y-axis as a front view and also defines a view in a positive direction of an X-axis, a view in a negative direction of the X-axis, and a view in a negative direction of the Z-axis, as a left side view, a right side view, and a plan view (that may also be referred to as a "top view"), respectively. Accordingly, in the following description, directions of the X-axis, directions of the Y-axis, and directions of the Z-axis may be referred to as leftward and rightward directions, forward and backward directions, and upward and downward directions, respectively.

As illustrated in FIG. 1, a toilet apparatus 1 includes a toilet bowl part 2, a toilet lid part 3, and a sanitary washing device 10. Herein, the toilet bowl part 2 is not limited to a floor-mounted type but may be a wall-hung type. Furthermore, although a washing water tank (illustration omitted) that stores washing water is installed in back of the toilet bowl part 2 in an illustrated example, the toilet apparatus 1 may be a so-called tank-less type where a washing water tank is not installed in back of the toilet bowl part 2.

Furthermore, the toilet bowl part 2 has a bowl 2*b* (see FIG. 2) that is provided on an upper surface of a toilet body (that will be referred to as a "toilet" below) 2*a* and receives sewage. Herein, the toilet bowl part 2 further has a headrace that introduces washing water to the bowl 2*b*, a trap pipeline that has an inlet connected to a bottom of the bowl 2*b* and discharges sewage in the bowl 2*b* to a drainage pipeline, and the like. Herein, the toilet 2*a* is made of, for example, a ceramic.

Furthermore, the toilet apparatus 1 is, for example, a so-called siphon type where sewage in the bowl 2*b* is suctioned into and discharged through a trap pipeline by utilizing siphonage. Herein, the toilet apparatus 1 is not limited to a siphon type but may be, for example, a so-called wash-out type where sewage is washed out by action of running water that is caused by a head drop of washing water in the bowl 2*b*.

Furthermore, the toilet 2*a* has an internal space. For example, a cover 2*c* is mounted on a rear half part of the toilet 2*a*, so that an internal space of the toilet 2*a* is formed between the toilet 2*a* and the cover 2*c*. A connection component 13 (see FIG. 2) of the sanitary washing device 10 is housed in an internal space of the toilet 2*a*.

The toilet lid part 3 is mounted on top of the toilet 2*a*. The toilet lid part 3 includes a toilet lid 3*a* and a toilet seat (illustration omitted). A rear edge of the toilet lid part 3 that is a rotation edge of the toilet lid 3*a* or the toilet seat in an upward or downward direction is mounted on the sanitary washing device 10. Furthermore, the sanitary washing device 10 is installed on an upper surface of the toilet 2*a*. That is, the sanitary washing device 10 is provided between the toilet bowl part 2 and the toilet lid part 3.

As illustrated in FIG. 2, the sanitary washing device 10 is installed on a rear part of an upper surface of the toilet 2*a* and sprays washing water toward, for example, a private part of a person that sits on a toilet seat to wash the private part of a person that sits on a toilet seat. In the sanitary washing device 10, the connection component 13 of a functional part (illustration omitted) provided inside a casing 11 (see FIG. 3) is provided to be directed from an inside of the casing 11 to an outside thereof. That is, the connection component 13 is exposed to an outside of the casing 11.

The connection component 13 may be, for example, a water supply pipe 13*a* that is connected to a water supply source (illustration omitted) or an electrical power supply cord 13*b* that is connected to an electrical power supply (illustration omitted). Furthermore, the connection component 13 may be a toilet washing jack 13*d* (see FIG. 4B) with a toilet washing plug 13*c* (see FIG. 4A) being connected thereto.

That is, the connection component 13 includes the water supply pipe 13*a*, the electrical power supply cord 13*b*, and the toilet washing lack 13*d*. Herein, the connection component 13 may include the toilet washing plug 13*c*. In such a case, the toilet washing plug 13*c* includes a cord portion that extends from a plug portion.

Herein, for example, in a case where a rotation lever that is provided on an outer side of a washing water tank and operated at a time of washing of the toilet 2*a* is operated by remote control, the toilet washing plug 13*c* electrically connects the sanitary washing device 10 and motor that drives the rotation lever to provide an electrical power supply via the sanitary washing device 10.

Furthermore, the sanitary washing device 10 is installed on the toilet 2*a* while water supply and electrical power supply is hidden in such a manner that the connection component 13 does not come into a field of view of a user in a case of installation thereof, that is, the connection component 13 is not exposed to an outside of the toilet apparatus 1.

In a case where the sanitary washing device 10 is installed on a rear part of an upper surface of the toilet 2*a*, the connection component 13 is inserted through a through-hole 2*d* provided on one of left and right sides (a left side in an illustrated example) on a rear part of an upper surface of the toilet 2*a* and housed in an internal space of the toilet 2*a* via the through-hole 2*d*. For example, the connection component 13 housed in an internal space of the toilet 2*a* penetrates through a wall 5 of a toilet room and is connected to a water supply source or an electrical power supply provided in a wall 5 without being exposes to an outside of the toilet apparatus 1.

Accordingly, the sanitary washing device 10 is configured to be capable of being preferably installed while water supply and electrical power supply is hidden. Additionally, a detail of the sanitary washing device 10 will be described later by using FIG. 3 and subsequent figures. Furthermore, as illustrated in FIG. 2, the sanitary washing device 10 is mounted on the toilet 2*a* via a mounting plate 4.

The mounting plate 4 is provided on a central part on a rear part of an upper surface of the toilet 2*a* and fixes the casing 11 between an upper surface of the toilet 2*a* and the casing 11 (a case plate 11*b*). The casing 11 is slid on an upper surface of the mounting plate 4 in a forward or backward direction, so that the casing 11 is attached thereto or detached therefrom.

As the casing 11 is slid from a front side to a back side by a predetermined amount, the casing 11 is mounted on the mounting plate 4. Furthermore, as the casing 11 is slid from a back side to a front side by a predetermined amount, the casing 11 is detached from the mounting plate 4. Thus, the mounting plate 4 fixes the sanitary washing device 10 and couples the toilet bowl part 2 and the toilet lid part 3 via the sanitary washing device 10.

Sanitary Washing Device

Figure 3:
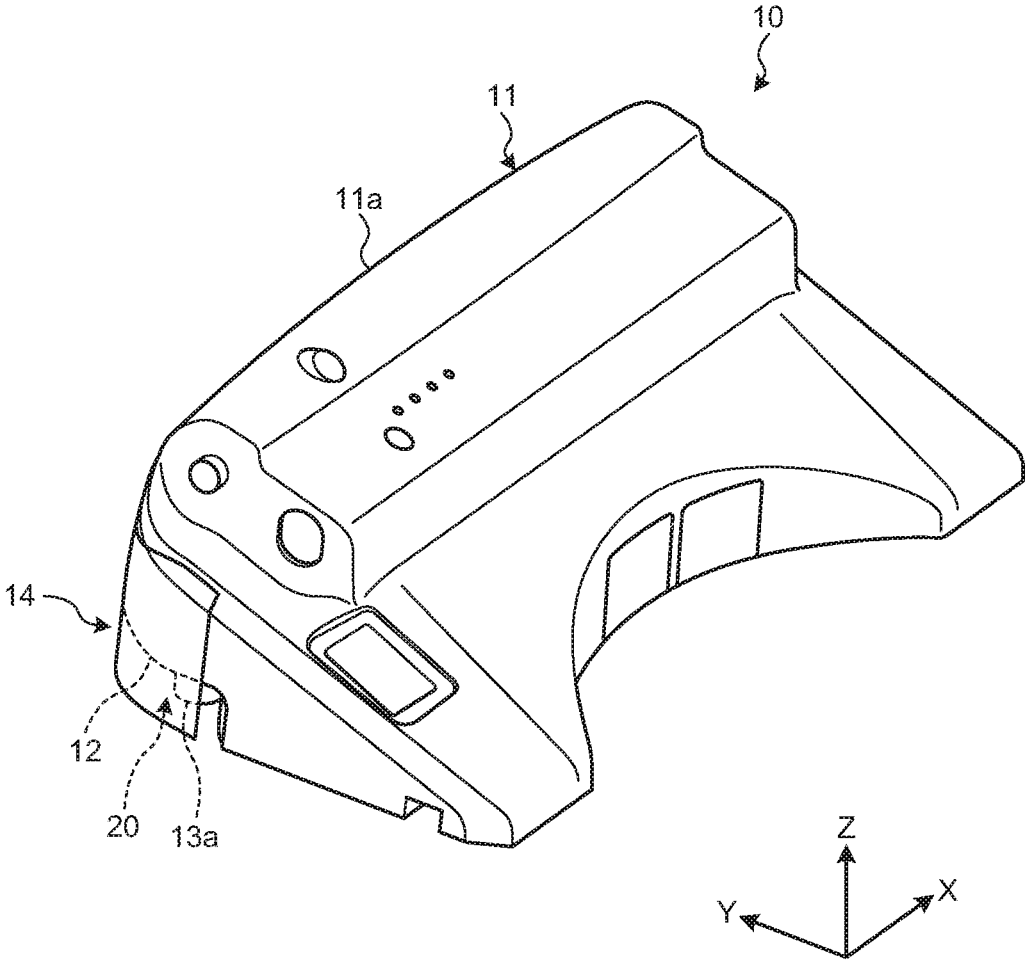
FIG. 3 is a schematic perspective view of a sanitary washing device according to an embodiment.
Figure 4A:
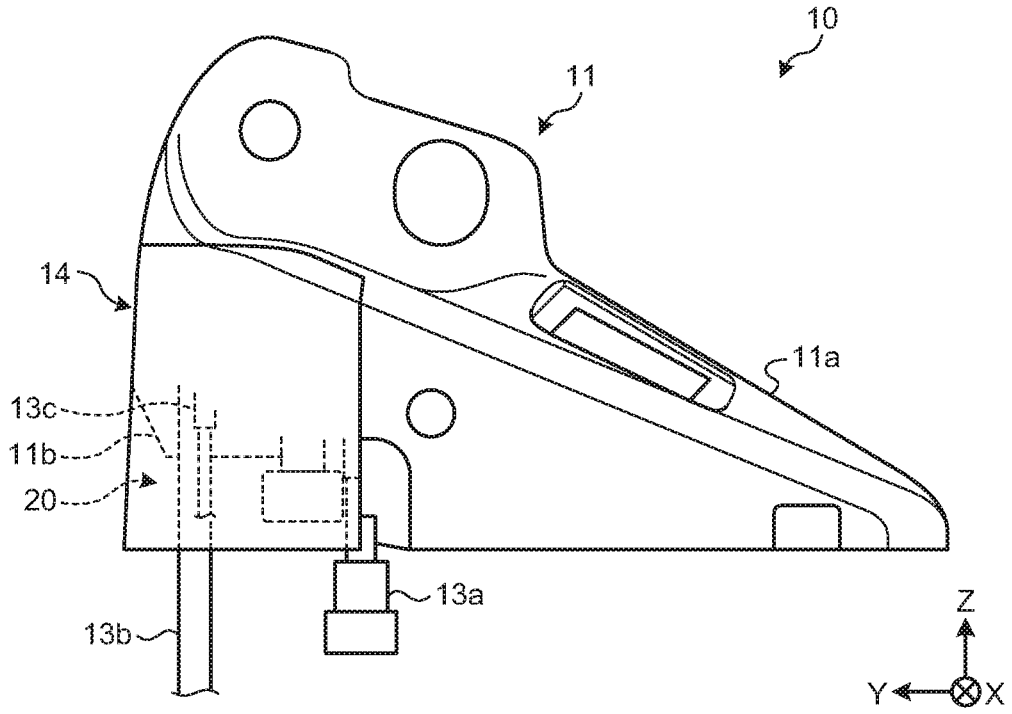
FIG. 4A is a schematic side view (part 1) of a sanitary washing device according to an embodiment.
Figure 4B:
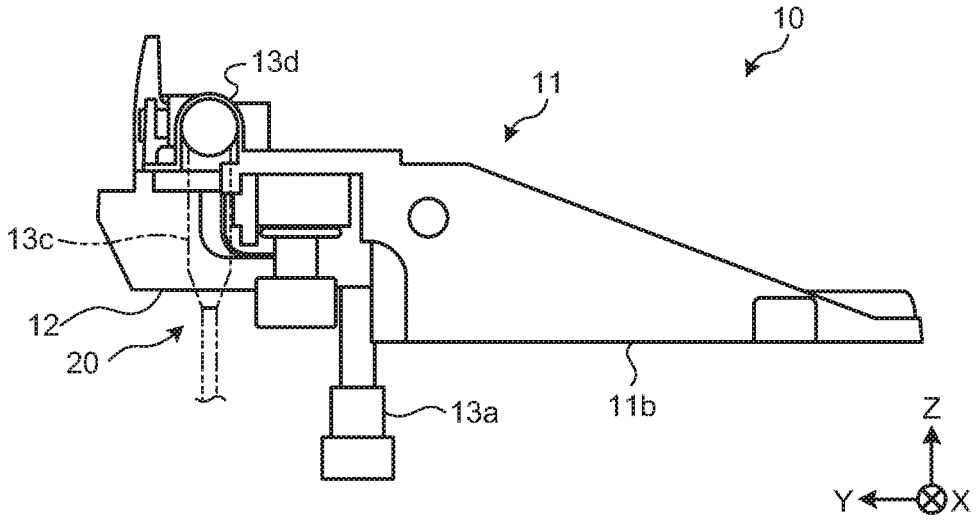
FIG. 4B is a schematic side view (part 2) of a sanitary washing device according to an embodiment.
Figure 5:
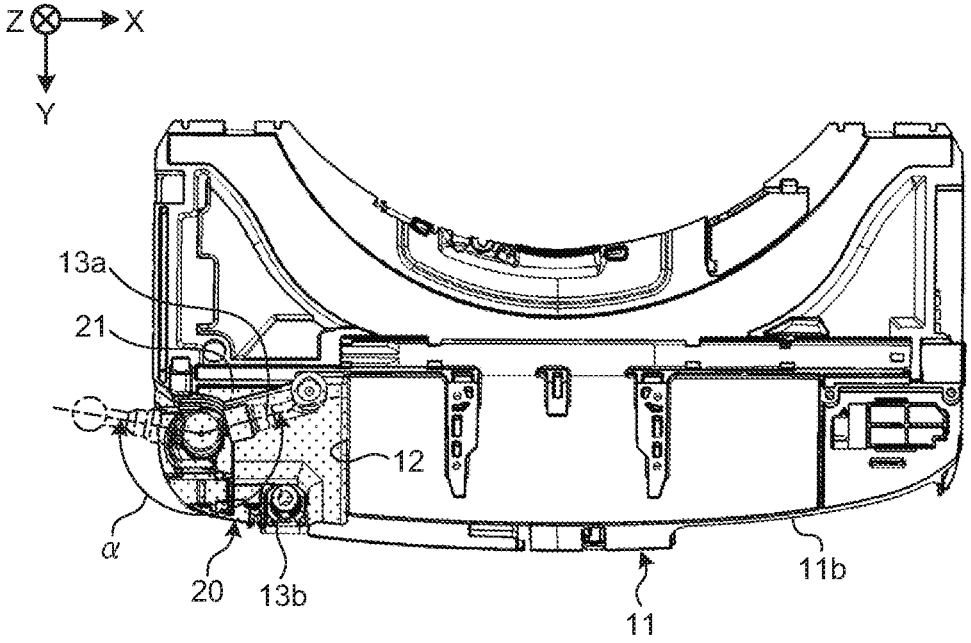
FIG. 5 is a schematic bottom view of a casing.

Next, a configuration of the sanitary washing device 10 according to an embodiment will be described with reference to FIG. 3 to FIG. 5. FIG. 3 is a schematic perspective view of the sanitary washing device 10 according to an embodiment. FIG. 4A and FIG. 4B are schematic side views of the sanitary washing device 10 according to an embodiment. FIG. 5 is a schematic bottom view of the casing 11.

Herein, FIG. 4A and FIG. 4B illustrate a left side surface of the sanitary washing device 10. Furthermore, FIG. 4A illustrates a state where a case cover 11*a* is mounted thereon, and FIG. 4B illustrates a state where the case cover 11*a* is detached therefrom.

As illustrated in FIG. 3, the sanitary washing device 10 includes the casing 11, a functional part (illustration omitted), and for example, the water supply pipe 13*a* that is the connection component 13 (see FIG. 2) in the functional part. The casing 11 includes a case cover 11*a* that is a top part of the casing 11 and a case plate 11*b* that is a bottom part of the casing 11. The functional part is housed in the casing 11. Specifically, the functional part is mounted on the case plate 11*b* and an upper side thereof is covered by the case cover 11*a*.

The functional part has, for example, a sanitary washing nozzle that washes a private part of a person that sits on a toilet seat, a deodorization device that eliminates an odor in the bowl 2*b* (see FIG. 2), or the like, as well as devices that contribute to water supply and electrical power supply functions. Herein, the functional part is arranged on one surface of the case plate 11*b*. Furthermore, the functional part has the connection component 13 for external connection (see FIG. 2).

As described above, the connection component 13 includes the water supply pipe 13*a*, the electrical power supply cord 13*b*, the toilet washing plug 13*c*, and the toilet washing jack 13*d*.

Herein, the through-hole 2*d* (see FIG. 2) of the toilet 2*a* is provided on, for example, a left side on a rear part of an upper surface of the toilet 2*a*. Accordingly, in the sanitary washing device 10, the connection component 13 as described above, namely, the water supply pipe 13*a*, the electrical power supply cord 13*b*, the toilet washing plug 13*c*, and the toilet washing jack 13*d*, may be arranged so as to be concentrated in a left side on a rear part of the casing 11 (case plate 11*b*).

Thereby, in a case where installation is executed while water supply and electrical power supply is hidden, work for hiding the water supply pipe 13*a* or the electrical power supply cord 13*b* is facilitated, and thereby, it is possible to improve construction thereof. Furthermore, the water supply pipe 13*a* or the electrical power supply cord 13*b* is not exposed to an outside thereof, and hence, an appearance is improved in a design. Thereby, it is possible to improve a design.

The casing 11 is mounted on an upper surface of the toilet 2*a* (see FIG. 2). A decorative cover 14 is mounted on the casing 11 at a site where the water supply pipe 13*a* or the electrical power supply cord 13*b* is arranged, that is, at a rear edge and a left edge of the casing 11 in such a manner that the water supply pipe 13*a* or the like is not exposed to an outside thereof. The decorative cover 14 covers at least a side surface of the casing 11. Herein, a part that is covered by the decorative cover 14 is provided with a notch or a hole so as to separate an inside and an outside of the casing 11 and be accessible to the toilet washing jack 13*d* or the like.

Thus, a part that is exposed to an outside of the casing 11 is hidden by the decorative cover 14, so that it is possible to further improve a design thereof. Furthermore, in such a case, when a color of the decorative cover 14 is identical to, for example, a color of the casing 11, the toilet bowl part 2 (toilet 2*a*), or the like, it is possible to readily improve a design thereof. Herein, the decorative cover 14 is made of, for example, a resin.

Furthermore, a part of the decorative cover 14 that is arranged on at least a side surface of the casing 11 extends downward.

Furthermore, the casing 11 is provided with a recess 12 at a site where the water supply pipe 13*a* or the electrical power supply cord 13*b* is arranged, that is, at a rear edge and a left edge of a lower surface (that is also referred to as a "bottom surface") of the casing 11. In other words, the recess 12 is arranged on one of left and right peripheral sides of the casing 11. The recess 12 is a site that is formed into a spot-facing shape so as to have a step against another site on a lower surface of the casing 11.

The recess 12 forms an open space 20 where, for example, an end edge of a side surface (for example, a left side surface) to a start end of a back surface of the casing 11 is opened, in a state where the casing 11 is mounted on the toilet 2*a*. That is, the open space 20 is formed by an upper surface of the toilet 2*a*, a lower surface of the casing 11 (recess 12), and a side wall surface of the recess 12. The recess 12 and the open space 20 will be described later by using FIG. 4A, FIG. 4B, and FIG. 5.

As illustrated in FIG. 4A and FIG. 4B, in the sanitary washing device 10, in a case where the water supply pipe 13*a*, the electrical power supply cord 13*b*, the toilet washing plug 13*c*, and the toilet washing jack 13*d* are arranged in the recess 12 (open space 20 in a case where the casing 11 is installed on the toilet 2*a*) provided on a lower surface of the casing 11 (that is also referred to as a case plate 11*b*). Herein, the decorative cover 14 is mounted on the casing 11, so that it is not possible to view an inside of the recess 12 from an outside thereof.

Furthermore, one end of the water supply pipe 13*a* is connected to a water supply inlet (illustration omitted) on a lower surface of the casing 11, in other words, on a surface that is opposite to an upper surface of the toilet 2*a* in a case where the casing 11 is installed on the toilet 2*a* (see FIG. 2). Furthermore, the other end of the water supply pipe 13*a* is connected to a water supply source. Furthermore, the water supply pipe 13*a* is rotatably connected to a lower surface of the casing 11 in a direction of the lower surface.

As illustrated in FIG. 5, the recess 12 is provided on a lower surface of the casing 11. Furthermore, as described above, the water supply pipe 13*a* is arranged in the recess 12 to form the open space 20 in a state where the casing 11 is mounted on the toilet 2*a*. In the open space 20, the water supply pipe 13*a*, the electrical power supply cord 13*b*, or the like is arranged to be capable of being laid. Furthermore, the through-hole 2*d* (see FIG. 2) provided on an upper surface of the toilet 2*a* is arranged in the open space 20.

Thus, it is possible to arbitrarily arrange the water supply pipe 13*a* in the open space 20 in the sanitary washing device 10 according to an embodiment, and hence, it is possible to draw the water supply pipe 13*a* in an arbitrary direction in the open space 20. Thereby, it is possible to lay the water supply pipe 13*a* in an arbitrary direction in the open space 20, and further, it is possible to lay the water supply pipe 13*a* on a back surface of the casing 11 without being exposed to a side surface of the casing 11, so that it is possible to improve a design.

Furthermore, the water supply pipe 13*a* is rotated in the open space 20, so that it is possible to lay he water supply pipe 13*a* is rotated in the open space 20. Furthermore, it is possible to correspond to the through-hole 2*d* that is provided at an arbitrary position of the toilet 2*a*. Thereby, it is possible to insert the water supply pipe 13*a* through the through-hole 2*d* readily and reliably. Thereby, an installation operation on the toilet 2*a* is facilitated, so that it is possible to improve a design thereof. Furthermore, it is also possible to lay the water supply pipe 13*a* outside the casing 11, and hence, even in a case where the through-hole 2*d* is absent in the toilet 2*a*, an installation operation is facilitated, so that it is possible to improve a design.

Furthermore, the electrical power supply cord 13*b* is arranged in the recess 12 as described above. That is, the electrical power supply cord 13*b* is arranged in the open space 20 in a state where the casing 11 is installed on the toilet 2*a* (see FIG. 2).

Thus, the electrical power supply cord 13*b* is arranged in the open space 20 in the sanitary washing device 10 according to an embodiment, and hence, it is possible to arbitrarily lay the electrical power supply cord 13*b* in the open space 20, so that it is also possible to improve a design of the electrical power supply cord 13*b*. Furthermore, it is possible to insert the electrical power supply cord 13*b* through the through-hole 2*d*. Thereby, it is possible to hide the electrical power supply cord 13*b*. Furthermore, the electrical power supply cord 13*b* is not exposed to an outside, so that it is possible to improve a design.

Furthermore, the open space 20 has an opened part (that will be referred to as an "open part" below) from a side surface to a back surface of the casing 11. An open part of the open space 20 is covered by the decorative cover 14 that extends downward.

Thus, it is possible for the decorative cover 14 to hide an inside of the open space 20 from an outside thereof in the sanitary washing device 10 according to an embodiment. Thereby, it is possible to hide the water supply pipe 13*a*, the electrical power supply cord 13*b*, or the like that is arranged in the open space 20. Furthermore, the water supply pipe 13*a*, the electrical power supply cord 13*b*, or the like is not exposed to an outside, so that it is possible to improve a design.

As illustrated in FIG. 5, the water supply pipe 13*a* is rotated in a direction of a lower surface of the casing 11 while one end that is connected to a water supply inlet is a supporting point of rotation. The casing 11 includes, in the recess 12, a rotation restriction part 21 that contacts the water supply pipe 13*a* and restricts frontward rotation of the water supply pipe 13*a*. Herein, it is preferable for the rotation restriction part 21 to restrict rotation of the water supply pipe 13*a* at a position where the water supply pipe 13*a* is housed in the recess 12.

Herein, in an example as illustrated in FIG. 5, the rotation restriction part 21 restricts rotation of the water supply pipe 13*a* so as to provide a predetermined angle of rotation $\alpha$. Furthermore, the water supply pipe 13*a* is held at a predetermined position by the rotation restriction part 21 so as to be housed in the recess 12.

Thus, in the sanitary washing device 10 according to an embodiment, for example, an installation operation is executed in a state where rotation of the water supply pipe 13*a* is restricted by the rotation restriction part 21, so that it is possible to prevent rotation of the water supply pipe 13*a* to disturb an installation operation and the installation operation is facilitated. Thereby, it is possible to improve a design. Furthermore, effectiveness is also provided in a case where an installation operation is executed in a state where it is not possible to view a mounting position.

Figure 6A:
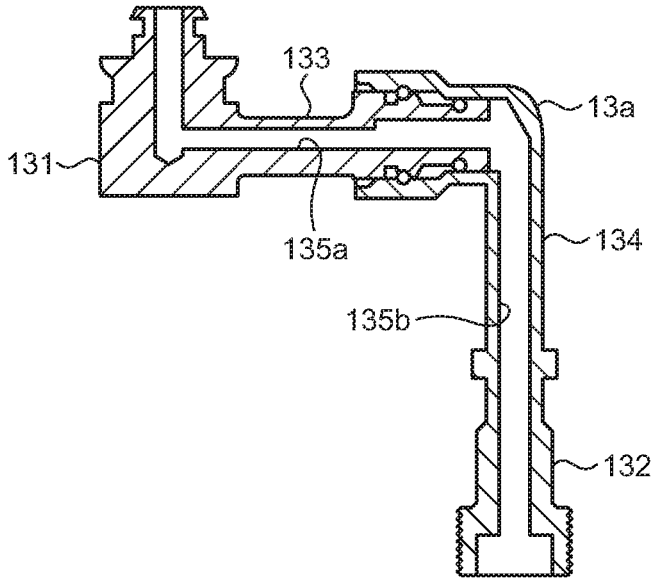
FIG. 6A is a schematic sectional side view of a water supply pipe.
Figure 6B:
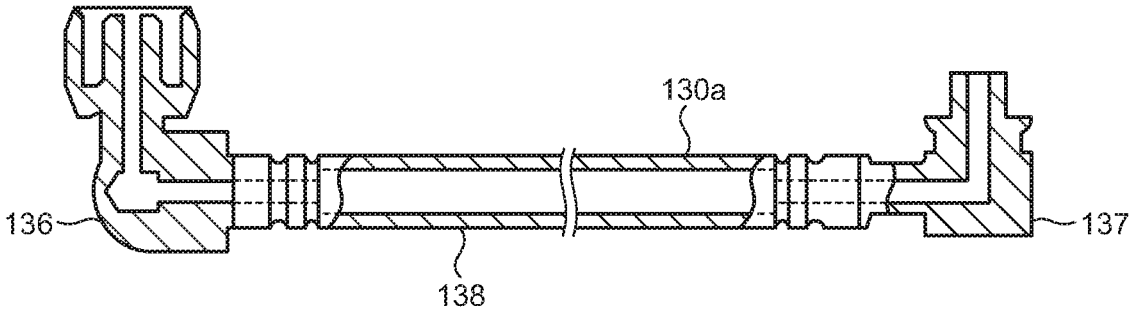
FIG. 6B is a schematic sectional side view of another example of a water supply pipe.

Herein, the water supply pipe 13*a* (and a water supply pipe 130*a*) will be described with reference to FIG. 6A and FIG. 6B. FIG. 6A is a schematic cross-sectional side view of the water supply pipe 13*a*. FIG. 6B is a schematic cross-sectional side view of another example of a water supply pipe (water supply pipe 130*a*). As illustrated in FIG. 6A, the water supply pipe 13*a* includes a water supply inlet side edge 131 that is connected to a water supply inlet and causes washing water to flow into an inside of the casing 11 (see FIG. 5), a water supply source side edge 132 that is connected to a water supply pipe (flexible hose) that extends from a water supply source, a first coupling part 133 that extends in a horizontal direction, and a second coupling part 134 that extends in a vertical direction.

That is, the water supply pipe 13*a* is formed into a crank shape and has two substantially rectangular curved parts. In the water supply pipe 13*a*, washing water that is supplied from the water supply source side edge 132 flows through a flow channel 135*b* of the second coupling part 134 in a vertical direction, subsequently flows through a flow channel 135*a* of the first coupling part 133 in a horizontal direction, and flows through a flow channel of the water supply inlet side edge 131, and the washing water is supplied to a water supply inlet. Herein, the water supply pipe 13*a* is made of, for example, a metal.

Furthermore, as illustrated in FIG. 6B, the water supply pipe 130*a* of a so-called elbow type that has one substantially rectangular curved part may be used instead of the water supply pipe 13*a*. That is, it is sufficient for a water supply pipe that is used for the sanitary washing device 10 to have at least one curved part. The water supply pipe 130*a* is different from the water supply pipe 13*a* of a crank type that is dropped in the through-hole 2*d* and drawn from an open part of the open space 20 to a side of the casing 11. Herein, the water supply pipe 130*a* includes a water supply inlet side edge 136 that is connected to a water supply inlet and causes washing water to flow into an inside of the casing 11 (see FIG. 5), a water supply source side edge 137 that is connected to a water supply pipe (flexible hose) that extends from a water supply source, and a coupling part 138 that extends in a horizontal direction.

Figure 7:
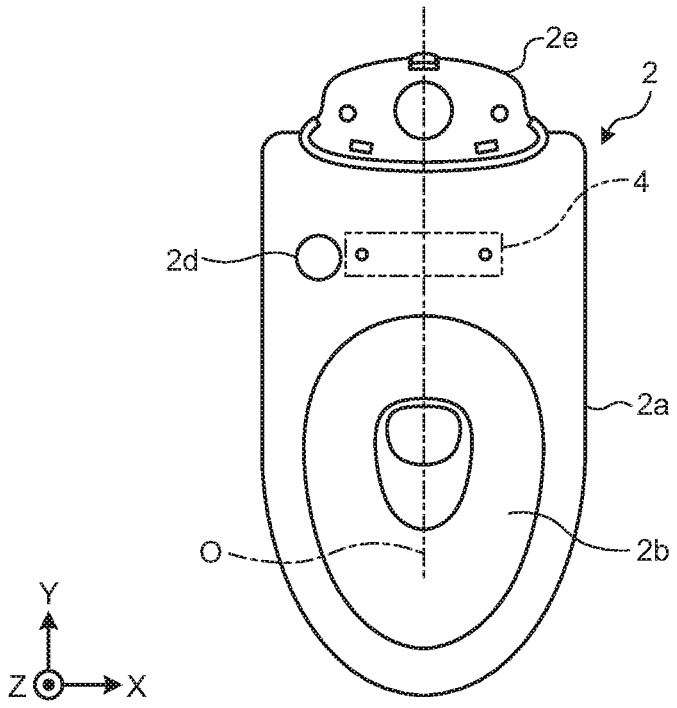
FIG. 7 is a schematic plan view of a toilet part.

Furthermore, the toilet bowl part 2 will be described herein, with reference to FIG. 7. FIG. 7 is a schematic plan view of the toilet bowl part 2. As described above, the toilet bowl part 2 includes the toilet 2*a*, the bowl 2*b*, the cover 2*c* (see FIG. 2), and the through-hole 2*d*. The toilet bowl part 2 further includes an installation table 2*e* where a washing water tank (illustration omitted) is installed. Furthermore, the mounting plate 4 is mounted on a central part of a rear part of the toilet 2*a*.

Furthermore, as illustrated in FIG. 7, the through-hole 2*d* where the water supply pipe 13*a* or the electrical power supply cord 13*b* (see FIG. 5) is inserted is provided on a left side with respect to a center line O of the toilet 2*a*, preferably, provided on a left side of the mounting plate 4. The water supply pipe 13*a* or the electrical power supply cord 13*b* is inserted through the through-hole 2*d* in a state where the casing 11 is installed on an upper surface of the toilet 2*a*. In addition, the toilet washing plug 13*c* (see FIG. 4B), or for more detail, a cord that extends from the toilet washing plug 13*c* is inserted through the through-hole 2*d*.

Figure 8:
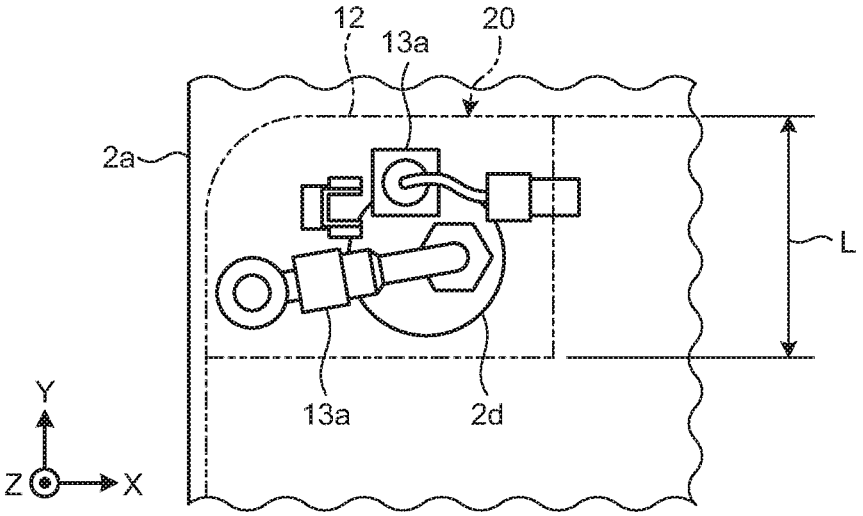
FIG. 8 is an illustration diagram of arrangement of a water supply pipe and an electrical power source cord.

Next, routing of the water supply pipe 13*a* and the electrical power supply cord 13*b* in a state where the casing 11 is mounted will be described with reference to FIG. 8. FIG. 8 is an illustration diagram of routing of the water supply pipe 13*a* and the electrical power supply cord 13*b*. Herein, FIG. 8 schematically illustrates, in a plan view, the open space 20 in a state where the casing 11 (see FIG. 5) is mounted.

As illustrated in FIG. 8, the through-hole 2*d* is arranged in the open space 20 formed by the recess 12 of the casing 11 and an upper surface of the toilet 2*a*. Furthermore, the water supply pipe 13*a* and the electrical power supply cord 13*b* are inserted through the through-hole 2*d* in the open space 20. In such a case, even when the through-hole 2*d* is provided at an arbitrary position, the water supply pipe 13*a* is rotated, so that it is possible to insert the water supply pipe 13*a* through the through-hole 2*d*.

Furthermore, a length L of the open space 20, that is, the recess 12 on a lower surface of the casing 11, in forward and backward directions (directions of the Y-axis) is provided to be a length equivalent to an amount of sliding in forward and backward directions in a case where the casing 11 is mounted on the mounting plate 4 (see FIG. 7).

Thus, in the sanitary washing device 10 according to an embodiment, a length of the recess 12 of the casing 11 in forward and backward directions is a length equivalent to an amount of sliding for mounting the casing 11, so that it is possible to reliably arrange the recess 12, for example, at a position that includes the through-hole 2*d* in the open space 20, due to sliding of the casing 11. That is, it is possible to realize reliable attachment or detachment of the casing 11 due to sliding of the casing 11. Thereby, it is possible to improve construction.

Figure 9A:
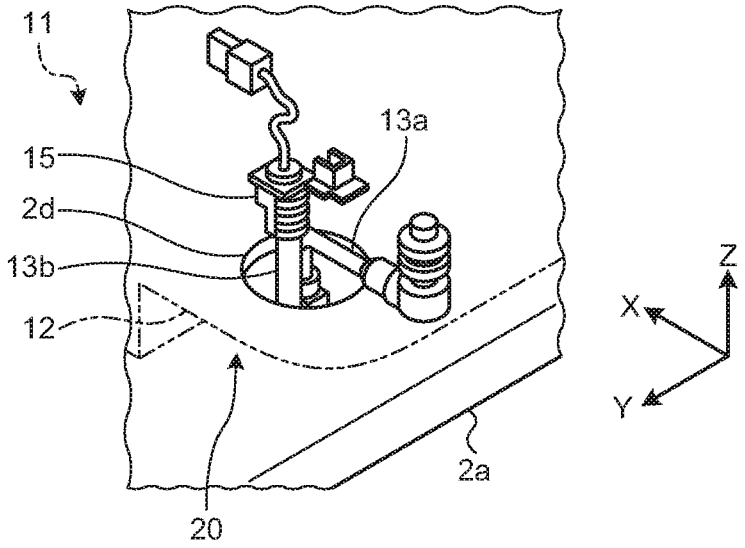
FIG. 9A is an illustration diagram (part 1) of a positional relationship between a water supply pipe and an electrical power source cord.
Figure 9B:
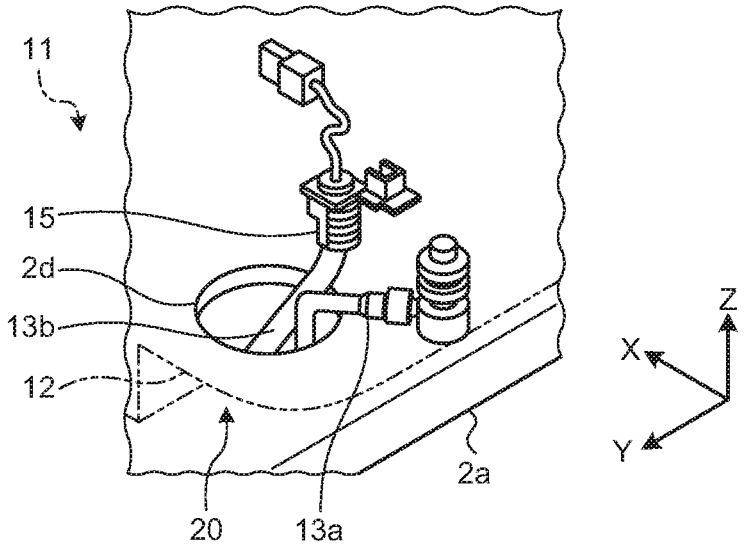
FIG. 9B is an illustration diagram (part 2) of a positional relationship between a water supply pipe and an electrical power source cord.

Next, a positional relationship between the water supply pipe 13*a* and the electrical power supply cord 13*b* in a state where the casing 11 is mounted will be described with reference to FIG. 9A and FIG. 9B. FIG. 9A and FIG. 9B are illustration diagrams of a positional relationship between the water supply pipe 13*a* and the electrical power supply cord 13*b*.

As illustrated in FIG. 9A, a position of connection of the water supply pipe 13*a* to a water supply inlet is arranged below a position of connection of the electrical power supply cord 13*b* to a connector 15 in the open space 20 that is formed by the recess 12 of the casing 11 and an upper surface of the toilet 2*a*.

As illustrated in FIG. 9B, a position of connection of the water supply pipe 13*a* is positioned below a position of connection of the electrical power supply cord 13*b*, so that interference of the electrical power supply cord 13*b* with a cord portion is caused in a case where the water supply pipe 13*a* is rotated. Even when the water supply pipe 13*a* interferes with a cord portion of the electrical power supply cord 13*b*, rotation of the water supply pipe 13*a* is substantially not disturbed due to flexibility of a cord.

Thus, in a case where the water supply pipe 13 in the sanitary washing device 10 according to an embodiment is configured to be rotatable, it is possible to avoid interference with the electrical power supply cord 13*b* even when the water supply pipe 13*a* is rotated.

Figure 10A:
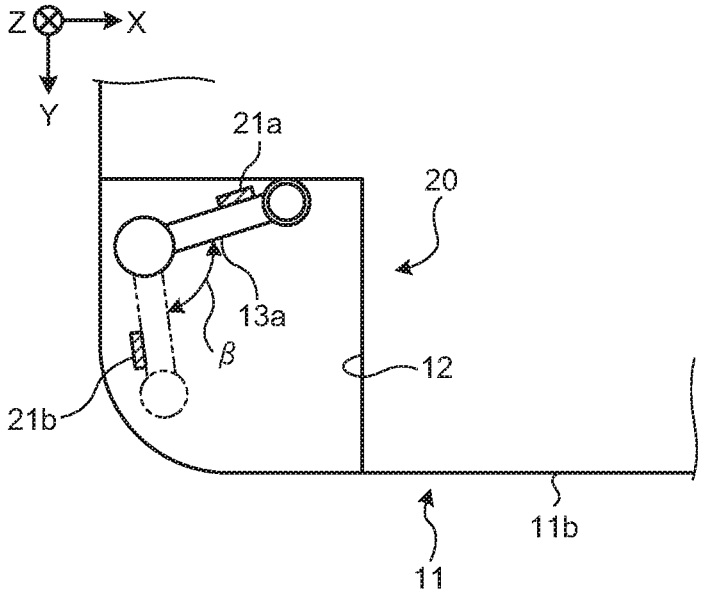
FIG. 10A is an illustration diagram of another example (part 1) of a rotation restriction part for a water supply pipe.
Figure 10B:
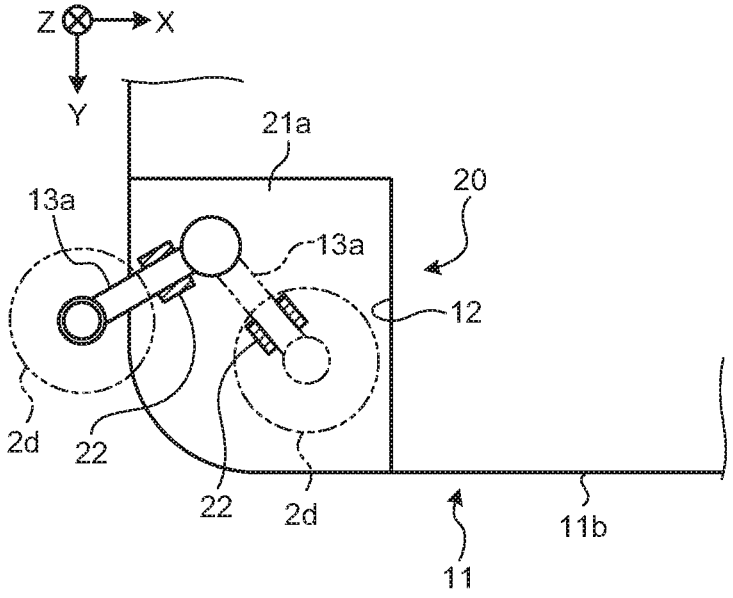
FIG. 10B is an illustration diagram of another example (part 2) of a rotation restriction part for a water supply pipe.

Next, other examples of a rotation restriction part for the water supply pipe 13*a* (rotation restriction parts 21*a*, 21*b*, 22) will be described with reference to FIG. 10A and FIG. 10B. FIG. 10A and FIG. 10B are illustration diagrams of other examples of a rotation restriction part of the water supply pipe 13*a*. Herein, FIG. 10A and FIG. 10B schematically illustrate, in a bottom view, the open space 20 formed by installing the casing 11 on an upper surface of the toilet 2*a*.

As illustrated in FIG. 10A, rotation restriction parts 21*a*, 21*b* for the water supply pipe 13*a* are provided in the recess 12 of the casing 11 (case plate 11*b*). The rotation restriction parts 21*a*, 21*b* restrict rotation of the water supply pipe 13*a* so as to provide an angle of rotation β, so that rotation of the water supply pipe 13*a* is restricted so as not to move from an inside to an outside of the open space 20. Thereby, the water supply pipe 13*a* is not exposed to an outside, and further, it is possible to correspond to a position of the through-hole 2*d* in the open space 20.

As illustrated in FIG. 10B, rotation restriction parts 22 of the water supply pipe 13*a* are provided in the recess 12 of the casing 11 (case plate 11*b*). The rotation restriction parts 22 arrange the water supply pipe 13*a* at predetermined positions in a pinpoint manner. Thereby, it is possible to insert the water supply pipe 13*a* through the through-hole 2*d* reliably. Furthermore, the plurality of rotation restriction parts 22 are provided as illustrated in the drawings, so that it is possible to correspond to a position of the through-hole 2*d*, even when, for example, the through-hole 2*d* is provided at a variety of positions depending on a specification of the toilet 2*a* (see FIG. 7).

Figure 11A:
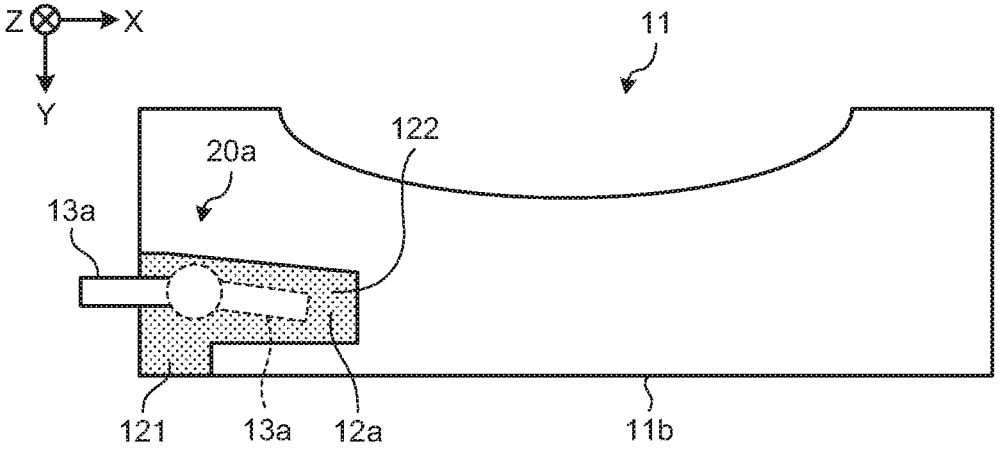
FIG. 11A is an illustration diagram of another example (part 1) of an open space.
Figure 11B:
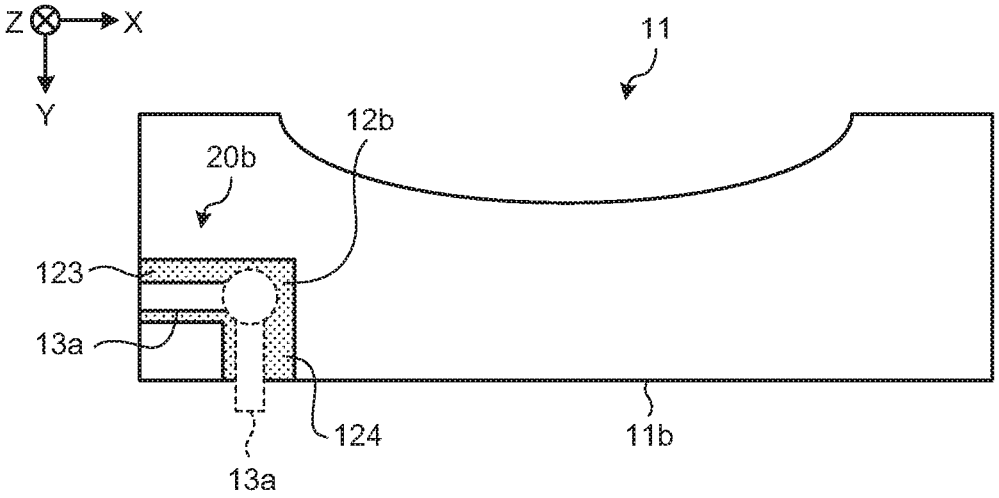
FIG. 11B is an illustration diagram of another example (part 2) of an open space.

Next, other examples of a recess of the casing 11, namely, an open space, will be described with reference to FIG. 11A and FIG. 11B. FIG. 11A and FIG. 11B are illustration diagrams of other examples of an open space (open spaces 20*a*, 20*b*). Herein, FIG. 11A and FIG. 11B schematically illustrate a lower surface (bottom surface) in a state where the casing 11 is installed on an upper surface of the toilet 2*a*, that is, the case plate 11*b*.

Furthermore, examples as illustrated in FIG. 11A and FIG. 11B are the open spaces 20 that are formed in a spot-facing shape depending on arrangement of the water supply pipe 13*a*. As illustrated in FIG. 11A, an open space 20*a* (recess 12*a*) includes a first space part 121 and a second space part 122. In the first space part 121, the water supply pipe 13*a* is rotatably arranged from a lateral side to a back side of the casing 11. In the second space part 122, the water supply pipe 13*a* is arranged toward a back side of the casing 11 so as to determine a position thereof, for example, in a substantially pinpoint manner. Herein, in the second space part 122, the water supply pipe 13*a* may be arranged rotatably at a small angle of rotation that is, for example, approximately 10 degrees.

Furthermore, a type of a water supply pipe may be changed depending on the toilet 2*a* or the like, in such a manner that, for example, the water supply pipe 130*a* of an elbow type (see FIG. 6B) is used as a water supply pipe that is arranged in the first space part 121 and the water supply pipe 13*a* of a crank type is used as a water supply pipe that is arranged in the second space part 122.

As illustrated in FIG. 11B, an open space 20*b* (recess 12*b*) includes a first space part 123 and a second space part 124. In the first space part 123, the water supply pipe 13*a* is arranged toward a lateral side of the casing 11 so as to determine a position thereof, for example, in a substantially pinpoint manner. In the second space part 124, a power supply pipe is arranged toward a back side of the casing 11 so as to determine a position thereof, for example, in a substantially pinpoint manner. Herein, in the first space part 123 and the second space part 124, the water supply pipe 13*a* may be arranged rotatably at a small angle of rotation that is, for example, approximately 10 degrees.

Furthermore, for example, the water supply pipe 130*a* of an elbow type (see FIG. 6B) may be used instead of the water supply pipe 13*a* of a crank type.

Thus, the open space 20*a*, 20*b* that is dependent on arrangement of the water supply pipe 13*a* (or the water supply pipe 130*a*) is formed, so that it is possible to insert the water supply pipe 13*a* through, for example, the through-hole 2*d* of the toilet 2*a* reliably. Furthermore, it is possible to deal therewith, for example, even in a case where the through-hole 2*d* is absent in the toilet 2*a* (see FIG. 7). That is, it is possible to improve construction.

Furthermore, the toilet apparatus 1 according to an embodiment includes the sanitary washing device 10 as described above, so that the water supply pipe 13*a*, the electrical power supply cord 13*b*, or the like is arranged between the open space 20 and an upper surface of the toilet 2*a* in the sanitary washing device 10, and hence, it is possible to lay the water supply pipe 13*a*, the electrical power supply cord 13*b*, or the like in the open space 20. Thereby, it is possible to improve construction.

Furthermore, the toilet apparatus 1 according to an embodiment includes the through-hole 2*d*, so that it is possible to insert the water supply pipe 13*a*, the electrical power supply cord 13*b*, or the like through the through-hole 2*d*. Thereby, it is possible to hide the water supply pipe 13*a*, the electrical power supply cord 13*b*, or the like. Furthermore, the water supply pipe 13*a*, the electrical power supply cord 13*b*, or the like is not exposed to an outside, so that it is possible to further improve a design.

According to an aspect of an embodiment, it is possible to improve a design or construction thereof.

Configuration (1) is a sanitary washing device, including a casing, a water supply pipe that is connected to the casing, and a recess that is arranged on one of left and right peripheral sides of the casing and forms, on a lower surface of the casing, an open space capable of laying the water supply pipe.

According to configuration (1), it is possible to arrange a water supply pipe in an open space arbitrarily, so that it is possible to draw such a water supply pipe in an arbitrary direction in such an open space. Thereby, it is possible to lay a water supply pipe in an arbitrary direction in an open space, and further, it is possible to lay such a water supply pipe on a back surface of a casing without being exposed to a side surface of the casing, so that it is possible to improve a design thereof. For example, in a case where a sanitary washing device is installed on a toilet, it is possible to lay a water supply pipe in a toilet, so that it is possible to improve a design thereof. Furthermore, a water supply pipe is also laid readily, so that it is possible to improve construction thereof.

Configuration (2) is the sanitary washing device according to configuration (1), wherein the water supply pipe is connected to the casing to be rotatable in a surface direction of the lower surface.

According to configuration (2), a water supply pipe is rotated, so that it is possible to lay such a water supply pipe in an open space. Furthermore, for example, in a case where a sanitary washing device is installed on a toilet, it is possible to cause a water supply pipe to correspond to a through-hole that is provided at an arbitrary position on a toilet in order to execute insertion thereof. Thereby, it is possible to insert a water supply pipe through a through-hole readily and reliably. Thereby, an installation operation is facilitated and it is possible to improve construction thereof. Furthermore, it is also possible to lay a water supply pipe outside a casing, so that an installation operation is facilitated and it is possible to improve construction thereof, even in a case where there is no through-hole in a toilet.

Configuration (3) is the sanitary washing device according to configuration (1), further including an electrical power source cord that is connected to the lower surface of the casing, wherein the electrical power source cord is arranged in the open space.

According to configuration (3), an electrical power source cord is arranged in an open space, so that it is possible to lay such an electrical power source cord arbitrarily in such an open space and it is also possible to improve construction of such an electrical power source cord. Furthermore, it is possible to insert an electrical power source cord through a through-hole. Thereby, it is possible to hide an electrical power source cord. Furthermore, an electrical power source cord is not exposed to an outside thereof, and thereby, it is possible to improve a design thereof.

Configuration (4) is the sanitary washing device according to configuration (3), wherein a connection position of the water supply pipe is provided below a connection position of the electrical power source cord.

According to configuration (4), in a case where a water supply pipe is configured to be rotatable, it is possible to prevent interference with an electrical power source cord even in a case where such a water supply pipe is rotated.

Configuration (5) is the sanitary washing device according to configuration (1), wherein the casing includes a rotation restriction part that restricts forward rotation of the water supply pipe with respect to the casing in the open space.

According to configuration (5), for example, an installation operation is executed in a state where rotation of a water supply pipe is restricted, so that such an installation operation is facilitated and it is possible to improve construction thereof.

Configuration (6) is the sanitary washing device according to configuration (1), wherein the casing is fixed on a toilet by a mounting plate provided on an upper surface of the toilet and slid on an upper surface of the mounting plate in a forward or backward direction and thereby provided to be attachable to and detachable from the mounting plate, and the recess has a length in a forward or backward direction that is equivalent to an amount of sliding of the casing.

According to configuration (6), a length of a recess of a casing in a forward or backward direction is a length that is equivalent to an amount of sliding to mount a casing, so that it is possible to arrange such a recess at a predetermined position (for example, a position where a through-hole is included in an open space) reliably, due to sliding of a casing. That is, it is possible to realize reliable attachment or detachment of a casing due to sliding of a casing. Thereby, it is possible to improve construction thereof.

Configuration (7) is the sanitary washing device according to configuration (1), further including a decorative cover that is mounted on the casing and covers at least a part of a side surface of the casing, wherein the decorative cover extends downward in such a manner that a part that covers the side surface of the casing covers an open part of the open space.

According to configuration (7), it is possible to hide an inside of an open space from an outside thereof. For example, in a case where a water supply pipe or an electrical power source cord is arranged in an open space, it is possible to hide it. Furthermore, a water supply pipe or an electrical power source cord is not exposed to an outside thereof, so that it is possible to improve a design thereof.

Configuration (8) is a toilet apparatus, including a sanitary washing device; and a toilet with the sanitary washing device being installed thereon, wherein the sanitary washing device includes a casing, a water supply pipe that is connected to the casing, and a recess that is arranged on one of left and right peripheral sides of the casing and forms, on a lower surface of the casing, an open space capable of laying the water supply pipe.

According to configuration (8), a water supply pipe, an electrical power source cord, or the like is arranged between an open space and an upper surface of a toilet in a sanitary washing device, so that it is possible to lay a water supply pipe, an electrical power source cord, or the like in an open space. Thereby, it is possible to improve construction thereof.

Configuration (9) is the toilet apparatus according to configuration (8), wherein the toilet includes a though-hole where at least one of the water supply pipe and an electrical power source cord that is connected to the lower surface of the casing is inserted therethrough.

According to configuration (9), it is possible to insert a water supply pipe or an electrical power source cord through a through-hole. Thereby, it is possible to hide a water supply pipe or an electrical power source cord. Furthermore, a water supply pipe or an electrical power source cord is not exposed to an outside thereof, so that it is possible to further improve a design thereof.

Although the invention has been described with respect to specific embodiments for a complete and clear disclosure, the appended claims are not to be thus limited but are to be construed as embodying all modifications and alternative constructions that may occur to one skilled in the art that fairly fall within the basic teaching herein set forth.

What is claimed is:

1. A sanitary washing device, comprising:

a casing;

a water supply pipe that is connected to the casing; and a recess that is arranged on one of left and right peripheral sides of the casing and forms, on a lower surface of the casing, an open space capable of laying the water supply pipe, wherein the water supply pipe is connected to the casing to be rotatable in a surface direction of the lower surface.

2. The sanitary washing device according to claim 1, further comprising:

an electrical power source cord that is connected to the lower surface of the casing, wherein the electrical power source cord is arranged in the open space.

3. The sanitary washing device according to claim 2, wherein a connection position of the water supply pipe is provided below a connection position of the electrical power source cord.

4. The sanitary washing device according to claim 1, wherein the casing is fixed on a toilet by a mounting plate provided on an upper surface of the toilet and slid on an upper surface of the mounting plate in a forward or backward direction and thereby provided to be attachable to and detachable from the mounting plate, and the recess has a length in a forward or backward direction that is equivalent to an amount of sliding of the casing.

5. The sanitary washing device according to claim 1, further comprising:

a decorative cover that is mounted on the casing and covers at least a part of a side surface of the casing, wherein the decorative cover extends downward in such a manner that a part that covers the side surface of the casing covers an open part of the open space.

6. A sanitary washing device, comprising:

a casing;

a water supply pipe that is connected to the casing; and a recess that is arranged on one of left and right peripheral sides of the casing and forms, on a lower surface of the casing, an open space capable of laying the water supply pipe, wherein the casing includes a rotation restriction part that restricts forward rotation of the water supply pipe with respect to the casing in the open space.

7. A toilet apparatus, comprising:

a sanitary washing device; and a toilet with the sanitary washing device being installed thereon, wherein the sanitary washing device includes:

a casing;

a water supply pipe that is connected to the casing; and a recess that is arranged on one of left and right peripheral sides of the casing and forms, on a lower surface of the casing, an open space capable of laying the water supply pipe, wherein the water supply pipe is connected to the casing to be rotatable in a surface direction of the lower surface.

8. The toilet apparatus according to claim 7, wherein the toilet includes a though-hole where at least one of the water supply pipe and an electrical power source cord that is connected to the lower surface of the casing is inserted therethrough.

* * * * *